US005301706A

United States Patent [19]

Jones

[11] Patent Number: 5,301,706

[45] Date of Patent: Apr. 12, 1994

[54] ULTIMATE PORTABLE BLIND

[75] Inventor: Steven C. Jones, Converse, Tex.

[73] Assignee: BBK Corporation, San Antonio, Tex.

[21] Appl. No.: 811,309

[22] Filed: Dec. 20, 1991

[51] Int. Cl.[5] ..... E04H 15/40

[52] U.S. Cl. ..... 135/104; 135/904

[58] Field of Search ..... 135/104, 102, DIG. 904

[56] References Cited

U.S. PATENT DOCUMENTS

| | | | |
|---|---|---|---|
| 1,067,660 | 7/1913 | Kay | 135/102 |
| 1,897,382 | 2/1933 | Blair | 135/104 |
| 2,142,851 | 1/1939 | Jolly | 135/102 |
| 2,594,410 | 4/1952 | Feldpausch | 135/102 |
| 3,133,550 | 5/1964 | Brown | 135/102 |
| 3,665,944 | 5/1972 | Knapp | 135/102 |
| 4,569,362 | 2/1986 | Fidler | 135/104 |
| 5,056,172 | 10/1991 | Kaiser | 135/104 |
| 5,059,463 | 10/1991 | Peters | 135/104 |

*Primary Examiner*—Henry E. Raduazo
*Attorney, Agent, or Firm*—Donald R. Comuzzi; Christopher L. Makay

[57] ABSTRACT

The present invention is a complete self-contained portable blind used to conceal a hunter, nature photographer, or nature watcher. The blind is configured such that it fits within an easily carried storage container.

12 Claims, 3 Drawing Sheets

ULTIMATE PORTABLE BLIND

BACKGROUND OF THE INVENTION

The present invention relates to a completely self-contained portable concealment facility used in outdoor activity and more particularly, to a blind used in rifle or bow hunting, nature photography, or nature watching.

In hunting, nature photograph, and nature watching, concealment has always been a major concern. Although blinds have been employed in the past as a method for concealment, conventional blinds presently in use are often cumbersome to carry and difficult to assemble. Conventional blinds often have a support frame constructed of aluminum rods which are both inflexible and unadjustable. Such poles are extremely unwieldy when carried through the woods and often do not provide a completely rigid support when assembled. In addition, the conventional blinds presently used require elaborate assembly procedures which are time consuming and take away from the desired activity such as hunting, nature photography, or nature watching.

Accordingly, the present invention has been designed to be completely self-contained, portable, and easily and quickly assembled and disassembled.

SUMMARY OF THE INVENTION

The portable blind of the present invention is constructed such that it fits entirely into a storage bucket for compact portability. Additionally, when the blind is assembled, the storage bucket also acts as a base for a swivel chair which provides 360 degrees of movement for increased visibility in the blind. The swivel chair is further provided with a removable padded T-bar gun rest which is adjustable for accuracy and personal comfort. The swivel chair design is described in U.S. Pat. No. D299,387.

The portable blind of the present invention is provided with an outer housing formed of two separate sections which may be connected together. The outer housing is attached to and supported by a support frame. The support frame has at least four telescoping support posts which may be adjusted to any height. Those support posts are interconnected via a support ring to provide support for the body section of the outer housing. Additionally, two roof supports are inserted into slots contained in the support ring to form a dome-shaped support which upholds the roof section of the outer housing. The entire blind structure is secured to the ground using stakes which are connected to the flip loop via a cord of some type.

The body section of the outer housing is fitted with a doorway which may be closed and at least four windows through which a hunter could fire either a rifle or bow.

Thus, it is an object of the present invention to provide a portable blind which is completely self-contained, portable, light weight and easily assembled and disassembled.

It is another feature of the present invention to provide the support frame with telescopic support poles which may be used to adjust the height and further to compress to a small enough size to fit in a small storage container.

It is still a further object of the present invention to provide the portable blind of the present invention with a storage container which serves as a swivel support for a chair.

It is still another object of the present invention to provide the swivel chair with an adjustable, removable, padded T-bar gun rest.

It is still a further object of the present invention to provide a portable blind with a flexible support loop that may be folded so that it fits in the storage container.

Still other features and advantages of the present invention will become evident to those skilled in the art in light of the following detailed description of the preferred embodiment.

DETAILED DESCRIPTION OF THE PREFERRED EMBODIMENT

Figure 1:
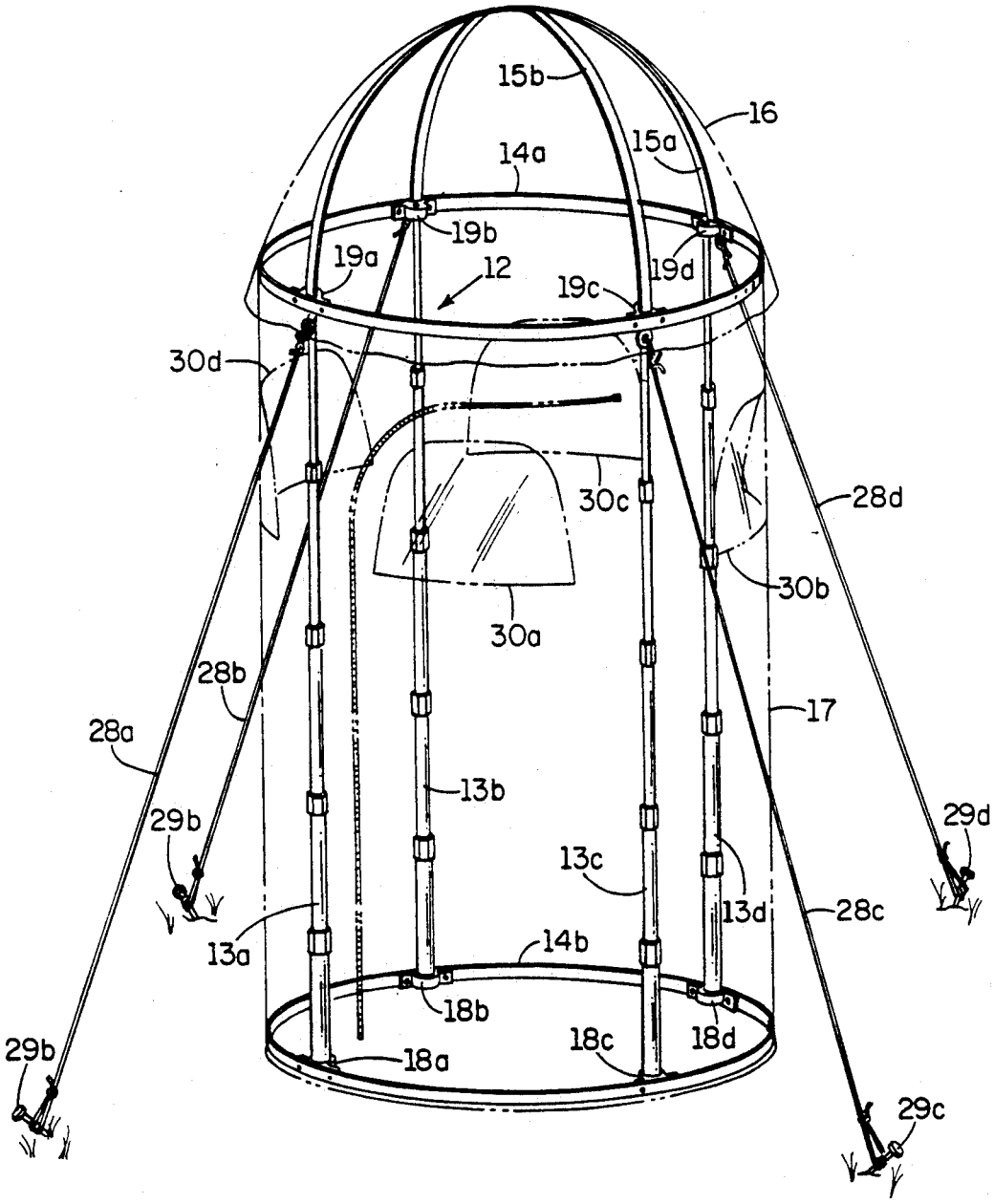
FIG. 1 is a perspective view showing the portable blind of the present invention.

Referring to FIG. 1, the preferred embodiment of the portable blind of the present invention will be disclosed. Portable blind 10 is comprised of a flexible outer covering 11 which is supported by support frame. 12. Support frame 12 is comprised of telescoping support posts 13-*d*, top support ring 14*a* and roof supports 15*a* and *b*. Outer covering 11 is comprised of a separate roof sect and body section 17 made of a suitable water repellant fabric. The roof section and body section may be connected using any conventional fastening means such as a zipper (used in the preferred embodiment), snaps, or velcro. The outer body section 17 is fastened at its top and bottom to the rings 14*a* and 14*b*, respectively. It may be connected by any suitable means such as stitching or with fasteners. To assemble, the rings 14*a* and 14*b* are unfolded to their full diameter. The telescoping support posts 13*a-d* are extended to the desired height and their bottom ends inserted into ring holders 18*a-d* attached to the bottom support ring 14*b*. Next, the upper ends of telescoping support posts 13A-D are connected to top support ring 14 via holders 19*a-d*. Additionally, roof supports 15A and B are connected to support ring 14*a* via holders 19*a-d*. Next, roof section 16 is draped over roof supports 15*a* and *b* and connected to body section 17. Finally, portable blind 10 is anchored to the ground using support ropes 28*a-d* and support pegs 29A-D. Support ropes 28*a-c* are connected to support ring 14 by any conventional means such as a hook and loop.

Figure 2A:
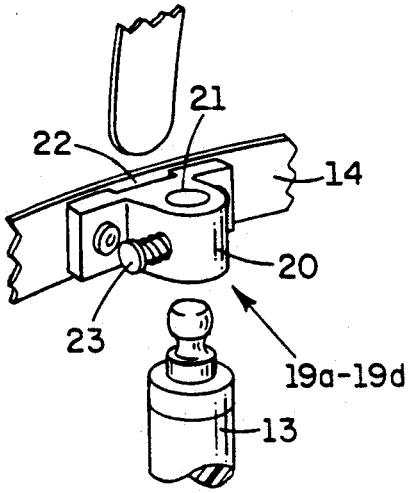
FIG. 2A is a perspective view of the holders used to attach the roof supports and telescoping support posts to the support ring.
Figure 2B:
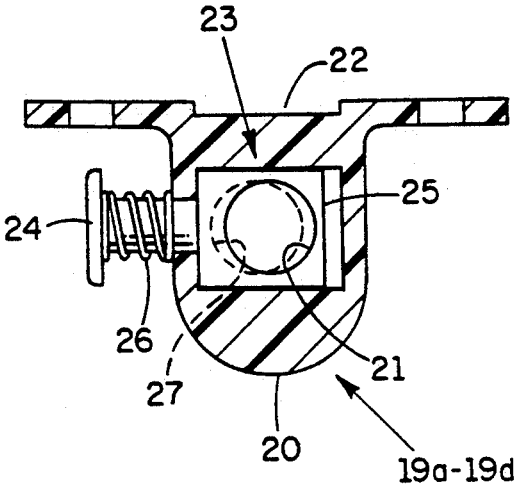
FIG. 2B is a top-view of the holders showing the fastener for the telescoping support posts.

Referring to FIGS. 2A and B, holders 19*a-d* will be disclosed. The holder comprises a body 20 fastened to support ring 14 by any conventional means such as a nut and bolt or pop rivet. The holder is fastened such that slot 22 is formed between body 20 and support ring 14. The ends of roof supports 15*a* and *b* are inserted into the produced slots to form the domed shaped roof section of portable blind 10. The holder is further provided with opening 21 which extends through body 20 and contain lock 23. The telescoping support posts are attached to support ring 14 and held in place by lock 23. Lock 23 is comprised of fastener 25, pin 24, and spring 26. Pin 24 is rigidly connected to fastener 25 through an opening (not shown) in body 20. Spring 26 is interposed between the head of pin 24 and body 20 to provide lateral movement of fastener 25. To operate, pin 24 is pressed in which compresses spring 26 and lines up opening 27 of fastener 25 with opening 21 of the holder. Next, the upper end of the telescoping support post is inserted into openings 21 and 27. Finally, pin 24 is released which causes an edge of opening 27 to be secured against the support post thereby fastening the support post to support ring 14.

The bottom ring holders 18*a–d* are identical in design and operation to top holders 19*a–d* and the bottom of the telescoping support posts 13*a–d* are connected to the holders 18*a*–18*d* in the same manner as the top of the posts and connected to holders 19*a*–19*b*.

Body section 17 is further provided with a doorway to provide ingress and egress to portable blind 10. The doorway is sealed using any conventional means such as a zipper, snap, or velcro. Additionally, body section 17 is provided with windows 30A–D so that a person in the blind may look out. Windows 30A–D can be opened and even removed so that a hunter may fire a weapon from the blind. In the preferred embodiment the windows are half moon shaped to facilitate use of a rifle; however, body section 17 may be provided with rectangular windows suitable for use with a conventional compound bow.

All the components which comprise portable blind 10 are configured such that they ca fit into an easily portable storage container (a six gallon bucket in the preferred embodiment). To provide compactness and portability, support ring 14 is constructed of a flexible material which allows it to be folded into a series of loops (see FIGS. 3A–D). The loops may be constructed from a suitable metal or plastic such as steel or fiberglass. It requires sufficient rigidity to maintain its expanded shape and support the body section 17 but must be flexible enough to be folded into the multiple loop configuration shown in FIGS. 3A–D.

Figure 3A:
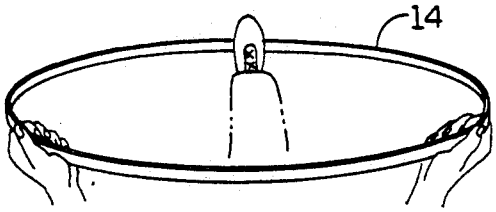
FIGS. 3A-D show the steps necessary for folding the support ring to its storage position.
Figure 3B:
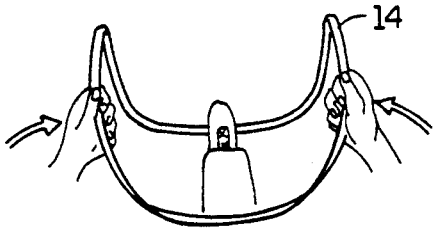
Figure 3C:
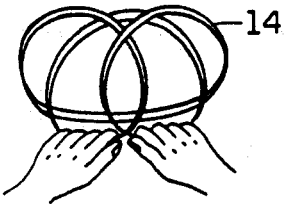
Figure 3D:
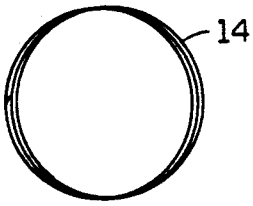

The technique of folding the rings 14*a* and 14*b* consists of five steps. For clarity, the technique is shown in FIGS. 3A–3D using only one ring 14 and with the outer cover section 17 removed. The first step (not shown) consists of holding both ring 14*a* and 14*b* together with the hands about three fee apart as shown in FIG. 3A. The rings are then held in a vertical position with a foot on the bottom of the rings (FIG. 3A). The rings are then turned by hand toward the center (FIG. 3B). Continue turning, bringing hands together and allowing the top of the rings to fold back towards the ground. When hands meet, fold, left over right and bring down towards the ground (FIG. 3C), remove the foot and allow the rings to fold (FIG. 3D).

Figure 4B:
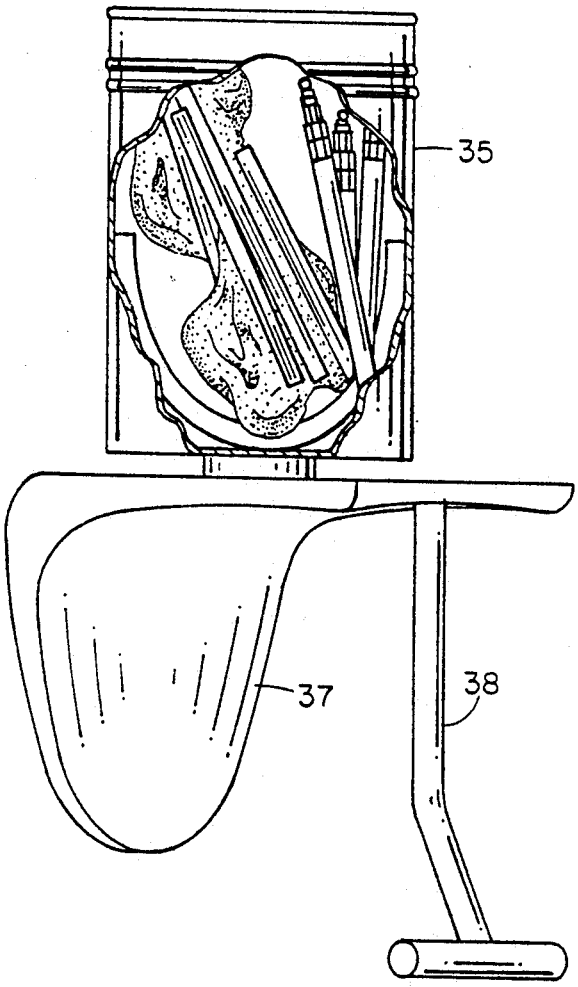
FIG. 4B shows the storage container with stored inside.
Figure 4A:
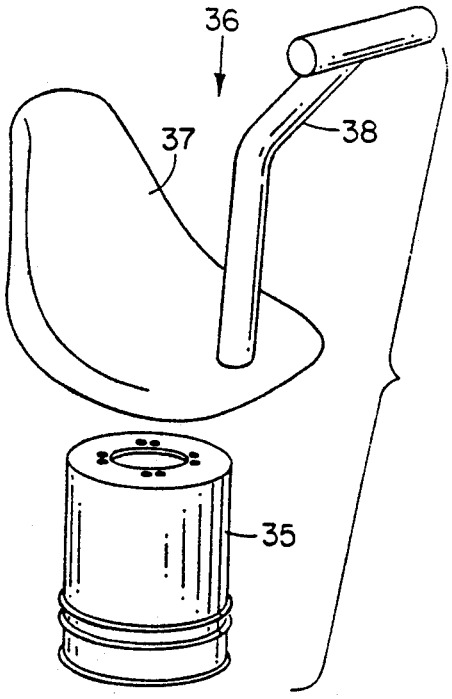
FIG. 4A shows the portable swivel chair/storage container.

Additionally, storage container 35 of portable blind 10 may be used as the base for a swivel chair 36 (see FIGS. 4A–4B). Swivel chair 36 has a seat 37 and T-bar gun rest 38 which may be attached to storage container 35. To assemble, T-bar gun rest 38 is threadably connected to storage container 35 with seat 36 interposed therebetween. Thus, swivel chair 36 is provided with 360 degrees of motion.

Figure 5:
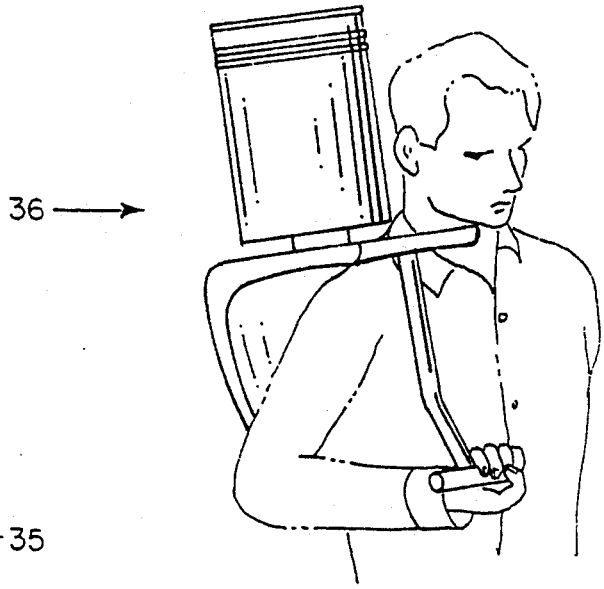
FIG. 5 shows the storage container in the transport position.

With the portable blind stored inside container 35 of swivel chair 36, the entire package may be easily transported with the seat 37 and the gun rest 38 fitting snugly over the shoulder of the user as shown in FIG. 5. Thus, the compact design of the portable blind in combination with the unique swivel chair design provides a compact, easily transportable configuration.

From the foregoing description and illustration of this invention, it is apparent that various modifications can be made by reconfigurations or combinations to produce similar results. It is therefore, the desire of the Applicant not to be bound by the description of this invention as contained in this specification, but to be bound only by the claims as appended hereto.

I claim:

1. A complete self-contained blind adapted to be folded and placed within a portable storage container, comprising:

a first support ring;

a second support ring;

a flexible body section secured between said first and second support rings, wherein said first and second support rings are adapted to collapse as a unit with said flexible body into a series of smaller loops to permit said first and second support rings and said flexible body section to fit within said storage container;

support posts for connection between said first and second support rings to support said body section in a raised position.

2. The apparatus according to claim 1 further comprising:

a roof support connected to said first support ring; and a roof section supported by said roof support.

3. The blind according to claim 2, wherein said first support ring includes means for holding said support posts.

4. The blind according to claim 2, wherein said first support ring further includes means for holding said roof support.

5. The blind according to claim 1, wherein said second support ring includes means for holding said support posts.

6. The blind according to claim 1, wherein said support posts telescope to allow storage within said storage container.

7. The blind according to claim 4, wherein said roof support comprises a pair of flexible bands that fit within said means for holding said roof support of said first support ring.

8. The blind according to claim 7, wherein said pair of flexible bands are adapted to fit within said portable storage container.

9. The blind according to claim 2, wherein said roof section removable attaches to said body section and further is adapted to fit within said portable storage container.

10. The blind according to claim 2, wherein said roof section is adapted to fit within said portable storage container.

11. The blind according to claim 1, wherein said body section includes a door and at least one window.

12. The blind according to claim 2, further comprising means attachable to said body section for anchoring said blind to the ground.

* * * * *